US008899740B2

(12) United States Patent
Ebina et al.

(10) Patent No.: US 8,899,740 B2
(45) Date of Patent: Dec. 2, 2014

(54) PRINT MEDIUM CONVEYANCE DEVICE AND PRINTING DEVICE

(75) Inventors: Koichi Ebina, Matsumoto (JP); Tomohisa Shirakawa, Suwa (JP)

(73) Assignee: Seiko Epson Corporation, Tokyo (JP)

( * ) Notice: Subject to any disclaimer, the term of this patent is extended or adjusted under 35 U.S.C. 154(b) by 7 days.

(21) Appl. No.: 13/591,159

(22) Filed: Aug. 21, 2012

(65) Prior Publication Data

US 2013/0050379 A1 Feb. 28, 2013

(30) Foreign Application Priority Data

Aug. 23, 2011 (JP) ..... 2011-181285

(51) Int. Cl.

| | |
|---|---|
| ***B41J 2/01*** | (2006.01) |
| ***B65H 20/20*** | (2006.01) |
| ***B65H 23/188*** | (2006.01) |
| ***B41J 11/30*** | (2006.01) |

(52) U.S. Cl.

CPC ..... *B41J 11/30* (2013.01); *B65H 2801/12* (2013.01); *B65H 20/20* (2013.01); *B65H 23/188* (2013.01); *B65H 2403/72* (2013.01)

USPC ..... 347/104

(58) Field of Classification Search

USPC ..... 347/104

See application file for complete search history.

(56) References Cited

U.S. PATENT DOCUMENTS

| | | | | |
|---|---|---|---|---|
| 4,759,649 | A * | 7/1988 | Kelly et al. | 400/616.3 |
| 5,305,068 | A | 4/1994 | Sato et al. | |
| 7,499,654 | B2 * | 3/2009 | Mihara | 399/16 |
| 2011/0142524 | A1 * | 6/2011 | Saito et al. | 400/578 |
| 2011/0200378 | A1 * | 8/2011 | Moriyama | 400/583 |

FOREIGN PATENT DOCUMENTS

| | | | |
|---|---|---|---|
| JP | 04-159956 | A | 6/1992 |
| JP | 2009-119574 | A | 6/2009 |

* cited by examiner

*Primary Examiner* — Shelby Fidler
*Assistant Examiner* — Tracey McMillion
(74) *Attorney, Agent, or Firm* — Kilpatrick Townsend & Stockton LLP

(57) ABSTRACT

A print medium conveyance device 40 has a tractor 44, conveyance roller 55, and clutch mechanism 83. The tractor 44 sequentially engages engagement holes formed in a line in the medium and conveys the print medium in a specific conveyance direction X. The conveyance roller 55 is disposed downstream from the tractor 44 in the conveyance direction X, and has a friction layer 59 containing an inorganic particle dispersion formed on the surface. the clutch mechanism 83 is between the conveyance motor 72 and tractor 44, and interrupts transfer of drive power from the conveyance motor 72 to the tractor 44 at least in part under a specific condition. The print medium can therefore be conveyed with high precision while damage to the print medium by excessive tension can be prevented.

13 Claims, 4 Drawing Sheets

PRINT MEDIUM CONVEYANCE DEVICE AND PRINTING DEVICE

This application claims priority to Japanese Application No. 2011-181285, filed on Aug. 23, 2011, the entirety of which is incorporated by reference herein.

BACKGROUND

1. Technical Field

The present invention relates to a conveyance device that conveys print media with sprocket holes (engagement holes) such as tractor feed fanfold paper, and to a printing device having the conveyance device.

2. Related Art

Media conveyance devices of this type have a tractor that conveys print media in a specific conveyance direction by sequentially engaging engagement holes ("sprocket holes" below) formed in the print medium, and a conveyance roller disposed near the printhead of the printing device. The tractor and conveyance roller are connected by a drive power transfer mechanism such as a gear train or belt, and conveys the print medium in specific increments by controlling synchronously driving the tractor and conveyance roller. See, for example, Japanese Unexamined Patent Appl. Pub. JP-A-2009-119574.

Because print media such as fanfold paper is unfolded and conveyed from a stack, the tractor and conveyance roller are driven at different conveyance speeds to apply tension to the print medium and remove slack and skewing. More specifically, the conveyance speed of the conveyance roller is faster than the conveyance speed of the tractor. Because the tractor engages the sprocket holes, the tractor holds the print medium with greater force than the conveyance roller, and the conveyance roller therefore slips against and applies tension to the print medium as described in Japanese Unexamined Patent Appl. Pub. JP-A-H04-159956.

In order to meet the need for high print quality, the conveyance distance of the conveyance roller must be controlled with high precision. To control conveyance with high precision, the coefficient of friction of the surface of the conveyance roller must be increased to reduce slipping against the print medium. However, if slipping of the conveyance roller is suppressed too much when the tractor and conveyance roller are connected by a drive power transfer mechanism as described above, conveyance differences due to the condition of the print medium and the conveyance precision of the tractor cannot be absorbed by the conveyance roller and accumulate, and the need for high precision conveyance cannot be met. Extreme tension may also be applied to the print medium when the tractor switches from forward to reverse conveyance, possibly resulting in the print medium tearing where the tractor engages the sprocket holes.

SUMMARY

The present invention is directed to solving at least part of the foregoing problem, and provides a print medium conveyance device that can convey the print medium with high precision and prevent damage to the print medium by excess tension, and a printing device having this conveyance device.

Preferred aspects of the invention solving at least part of the foregoing problem are described below.

One aspect of the invention is a print medium conveyance device having a first conveyance mechanism that sequentially engages engagement holes formed aligned in a print medium and conveys the print medium in a specific conveyance direction; a second conveyance mechanism that is disposed on the downstream side of the first conveyance mechanism in the conveyance direction, and has a friction layer containing an inorganic particle dispersion formed on the surface; a drive power source that drives the first conveyance mechanism and second conveyance mechanism; and a clutch mechanism that is disposed between the drive power source and the first conveyance mechanism, and interrupts transfer of drive power at least in part from the drive power source to the first conveyance mechanism under a specific condition.

The surface friction layer containing an inorganic particle dispersion has an extremely high friction coefficient, produces substantially no slipping against the print medium, and enables conveying the print medium with high precision. In addition, because transfer of drive power from the drive power source to the first conveyance mechanism is interrupted under a specific condition, the first conveyance mechanism can follow the operation of the second conveyance mechanism.

The clutch mechanism of the conveyance device interrupts transfer of drive power when torque exceeding a specific threshold is applied to the first conveyance mechanism. As a result, transfer of drive power to the first conveyance mechanism can be interrupted when excessive tension is applied to the print medium.

In this case, the specific threshold is set based on tension applied to the print medium located between the second conveyance mechanism and the first conveyance mechanism, and the strength of the print medium. This enables desirably applying tension of a level that will not damage the print medium.

If the conveyance device also has a transfer mechanism that transfers drive power from the drive power source to both the first conveyance mechanism and second conveyance mechanism, driving the first conveyance mechanism and second conveyance mechanism can be synchronously controlled by a single drive power source.

Further preferably, when the inorganic particles include aluminum oxide particles with high hardness, a high friction coefficient can be maintained for a long time.

Further preferably, if the print medium conveyance speed of the second conveyance mechanism is set greater than the print medium conveyance speed of the first conveyance mechanism, slack and skewing of the print medium can be desirably removed.

Further preferably, the conveyance device also has a first sensor that detects the print medium conveyance distance by the first conveyance mechanism; and a second sensor that detects the print medium conveyance distance by the second conveyance mechanism, and has detection precision that is greater than the detection precision of the first sensor. This configuration increases the print medium conveyance precision of the second conveyance mechanism.

A print medium conveyance device according to another aspect of the invention also has a control unit that causes the first conveyance mechanism to follow the second conveyance mechanism by interrupting transfer of drive power from the drive power source to the first conveyance mechanism under a specific condition.

When conveying the print medium in reverse along the conveyance path to the upstream side, the first conveyance mechanism conveys the print medium at a faster speed than the conveyance speed of the second conveyance mechanism. As a result, slack and skewing can be desirably removed from the print medium.

Further preferably, the first conveyance mechanism of the print medium conveyance device is a tractor; and the second conveyance mechanism is a conveyance roller.

When the print medium is fanfold paper, printing continuously for a long time is possible.

Another aspect of the invention is a printing device having: a tractor that engages sprocket holes in a print medium and conveys the print medium along a conveyance path; a conveyance roller that is disposed to the conveyance path on the downstream side of the tractor, and conveys the print medium along the conveyance path; an inkjet head that is disposed to the conveyance path on the downstream side of the conveyance roller and prints on the print medium; a drive power source that drives the tractor; and a clutch that is disposed between the tractor and the drive power source.

In this printing device, the clutch interrupts transfer of drive power when torque exceeding a specific threshold is applied to the tractor. This configuration enables interrupting transfer of drive power to the tractor when excessive tension is applied to the print medium.

In this case, the specific threshold is set based on tension applied to the print medium located between the conveyance roller and the tractor, and the strength of the print medium. This enables desirably applying tension of a level that will not damage the print medium.

Other objects and attainments together with a fuller understanding of the invention will become apparent and appreciated by referring to the following description and claims taken in conjunction with the accompanying drawings.

DESCRIPTION OF EMBODIMENTS

A preferred embodiment of the present invention is described below with reference to the accompanying figures. Note that the accompanying figures are not necessarily drawn to scale and sizes are adjusted to enable different parts to be seen more clearly. In addition, the print medium conveyance direction is indicated by arrow X, the direction of the print medium width is indicated by arrow Y, and the direction of arrow Z is perpendicular to directions X and Y.

Figure 1:
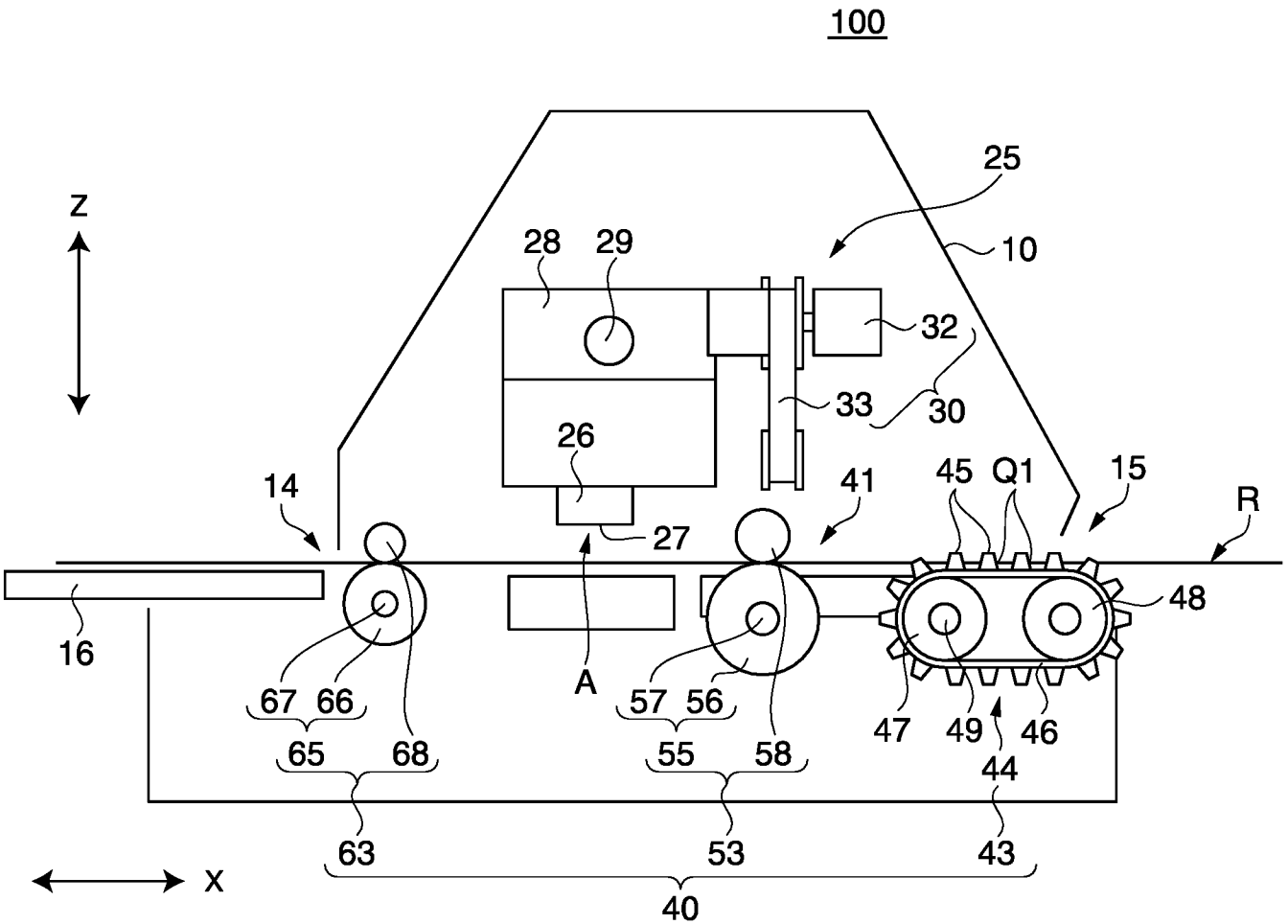
FIG. 1 schematically describes an inkjet printer according to a preferred embodiment of the invention.

FIG. 1 shows an inkjet printer 100 according to a preferred embodiment of the invention.

This inkjet printer 100 supplies paper R used as the print medium from a supply opening 15 provided at the back of the printer case 10, prints on the paper R at a print unit 25, and discharges the paper R from a paper exit 14 at the front of the case 10.

The print unit 25 includes a printhead 26, carriage 28, and carriage conveyance mechanism 30.

The printhead 26 has a plurality of nozzles 27 that eject ink droplets onto the paper R. The printhead 26 is mounted on the carriage 28 so that the nozzles 27 face down on the Z-axis shown in FIG. 1, that is, facing the paper R.

The carriage 28 is supported movably on a carriage shaft 29 that extends widthwise to the paper (the y-axis shown in FIG. 3), and is moved bidirectionally on the y-axis by the carriage conveyance mechanism 30.

The carriage conveyance mechanism 30 includes a carriage motor 32 and a timing belt 33 that is driven by the carriage motor 32. The carriage 28 is attached to the timing belt 33, and is moved bidirectionally on the y-axis by the carriage motor 32.

The inkjet printer 100 also has a conveyance device 40 that conveys the paper R. The conveyance device 40 includes a first conveyance mechanism 43, a second conveyance mechanism 53, a third conveyance mechanism 63, and a power transfer mechanism 70 (see FIG. 2).

The conveyance path 41 extends along the x-axis shown in FIG. 1 starting at the supply opening 15, passing the printing position of the printhead 26 of the print unit 25, and ending at the paper exit 14. The first conveyance mechanism 43, second conveyance mechanism 53, and third conveyance mechanism 63 are disposed in this order along the conveyance path 41 from the upstream side to the downstream side.

The first conveyance mechanism 43 is disposed near the supply opening 15, and includes a pair of tractors 44. Each tractor 44 has tractor pins 45, a tractor belt 46, a drive sprocket 47, and a follower sprocket 48.

The tractor pins 45 are engaging members that can be inserted to the sprocket holes (engagement holes) Q1 of the paper R, and plural pins are formed at a specific interval on the outside surface of each tractor belt 46. The tractor belt 46 is mounted on the drive sprocket 47 and the follower sprocket 48.

The two tractors 44 are disposed on opposite sides of the y-axis of the conveyance path 41 aligned with the sprocket holes Q1 formed along the opposite sides of the width of the conveyed paper R. The drive sprockets 47 of the tractors 44 are connected to each other by a drive shaft 49, and the pair of tractors 44 can therefore be driven synchronously.

The second conveyance mechanism 53 is located on the conveyance path 41 between the first conveyance mechanism 43 and the printing position A, and more specifically near the printhead 26. The second conveyance mechanism 53 includes a conveyance roller 55 and a pressure roller 58.

The conveyance roller 55 includes a metal roller 56 and a roller shaft 57, and is disposed crosswise to the conveyance path 41 below the conveyance path 41 on the z-axis. The pressure roller 58 is made of rubber or other elastic material, and is disposed so that it urges the paper R conveyed through the conveyance path 41 against the conveyance roller 55 from above on the z-axis.

Figure 3:
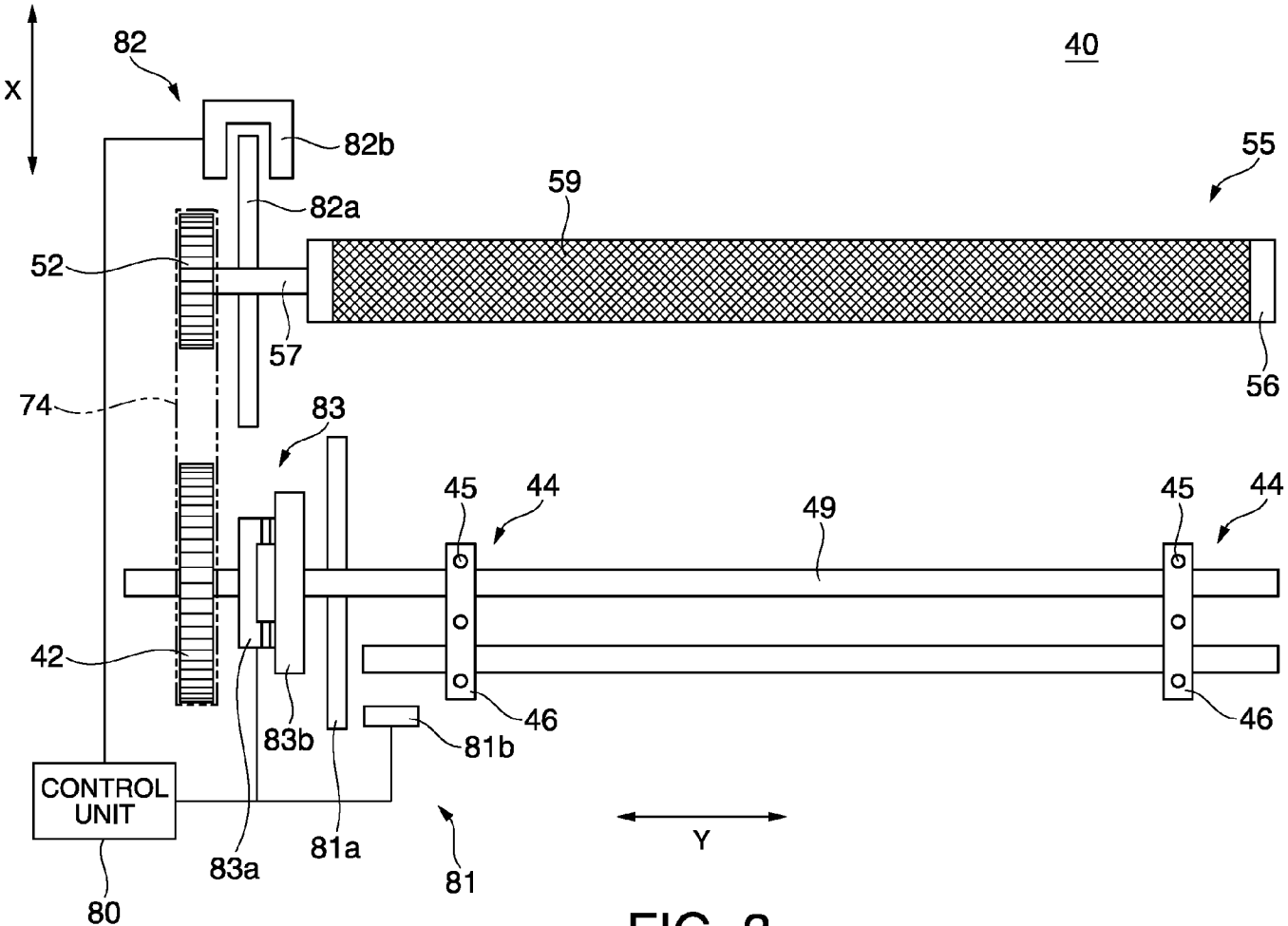
FIG. 3 is a plan view showing part of the conveyance device of the inkjet printer in FIG. 1.

As shown in FIG. 3, a friction layer 59 containing a dispersion of inorganic particles is formed on the surface of the metal roller 56. This friction layer 59 is made by dispersing an inorganic powder of aluminum oxide (alumina; Al2O3), silicon carbide (SiC), or silicon dioxide (SiO2) in a resin layer made of epoxy resin or polyester resin, for example.

Crushed alumina is used as the inorganic powder in this embodiment of the invention. Alumina is relatively inexpensive and does not interfere with reducing product cost, is relatively hard, and can be used effectively to increase wear resistance. Crushing also creates alumina powder with sharp edges, and produces a high friction force.

The third conveyance mechanism 63 is disposed to the conveyance path 41 between the printing position A and paper exit 14, and more specifically at a position near the printhead 26. The third conveyance mechanism 63 includes a discharge roller 65 and a pressure roller 68.

The discharge roller 65 includes a roller body 66 and a roller shaft 67, and is disposed crosswise to the conveyance path 41 below the conveyance path 41 on the z-axis. The pressure roller 68 is disposed to press the paper R conveyed through the conveyance path 41 against the discharge roller 65 from above on the z-axis.

Figure 2:
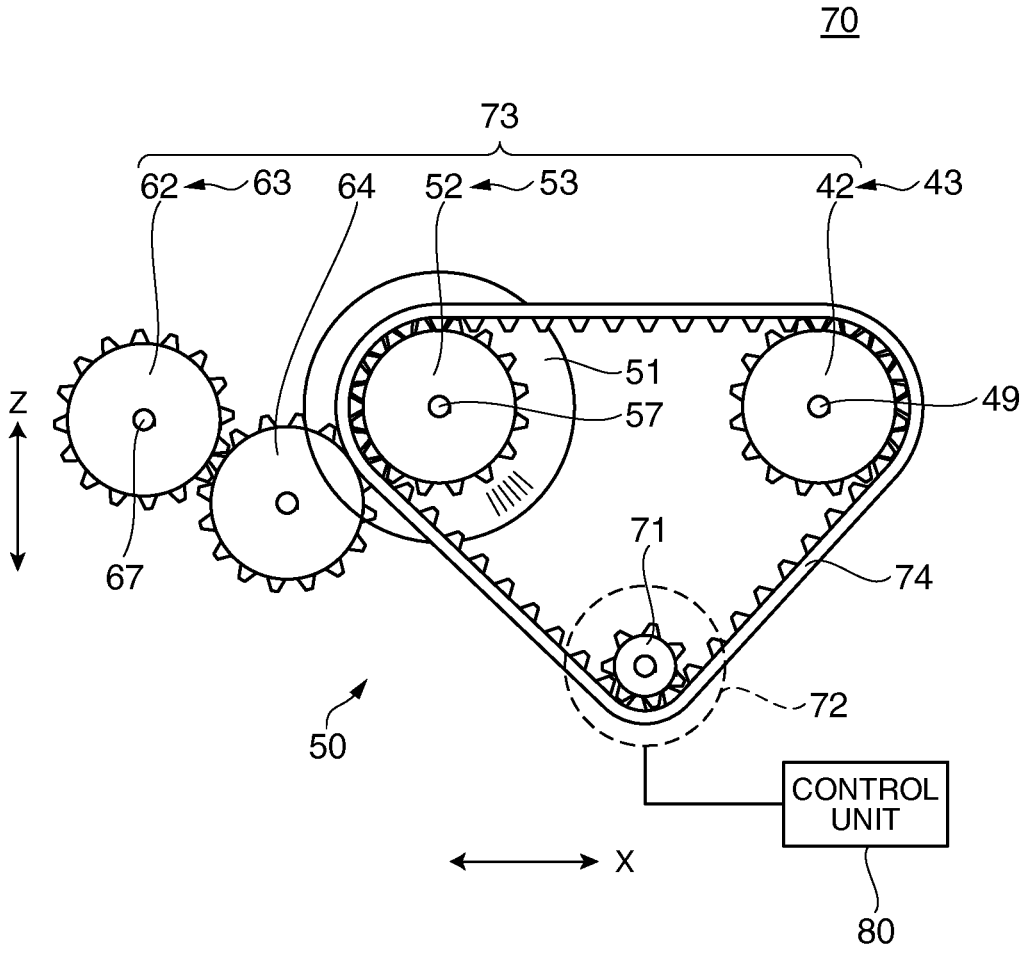
FIG. 2 is a side view showing part of the power transfer mechanism in the conveyance device of the inkjet printer shown in FIG. 1.

As shown in FIG. 2 and FIG. 3, a drive gear 42 is mounted on one end of the drive shaft 49 of the first conveyance mechanism 43. A drive gear 52 is also mounted on one end of the roller shaft 57 of the second conveyance mechanism 53, and a drive gear 62 is mounted on one end of the roller shaft 67 of the third conveyance mechanism 63.

As shown in FIG. 2, the power transfer mechanism 70 has a conveyance motor 72 as a drive power source with a motor gear 71, a gear train 73, and a toothed belt 74. The toothed belt 74 is an endless belt with internal teeth, and is mounted on the motor gear 71, the drive gear 42 of the first conveyance mechanism 43, and the drive gear 52 of the second conveyance mechanism 53. An intermediate gear 64 meshes with the drive gear 62 of the third conveyance mechanism 63, and the drive gear 52 of the second conveyance mechanism 53.

The conveyance device 40 comprised as described above directly transfers drive power from the conveyance motor 72 through the toothed belt 74 from the motor gear 71 to the drive gear 42 of the first conveyance mechanism 43 and the drive gear 52 of the second conveyance mechanism 53. The toothed belt 74 can be replaced with a gear train as appropriate.

The conveyance speed of the conveyance roller 55 of the second conveyance mechanism 53 can be set to a higher conveyance speed than the tractor 44 in the first conveyance mechanism 43 by adjusting the speed reducing ratio of the drive gear 42 and drive gear 52.

As shown in FIG. 3, a first sensor 81 for detecting the amount of drive sprocket 47 rotation (the media conveyance distance of the first conveyance mechanism) is disposed to one of the tractors 44.

The first sensor 81 in this embodiment is a rotary encoder, and has a disc 81*a* mounted on the drive shaft 49 of the drive sprocket 47, and a photosensor 81*b*. A pattern of reflective marks at a specific pitch is formed around the edge of the disc 81*a*. The photosensor 81*b* includes a light emitting element and a light detecting element, and detects how far the drive sprocket 47 has rotated, and thereby the conveyance distance of the paper R by the tractor 44, by the light detecting element detecting the reflection of light emitted by the emitter by the reflection pattern on the disc 81*a*.

The first sensor 81 could also be configured as a photosensor including light emitting and detecting devices disposed in opposition with one edge of the y-axis of the paper R therebetween. In this case, the conveyance distance of the paper R by the tractor 44, or more specifically the rotation of the drive sprocket 47, can be detected by the light detecting element detecting the passage of light emitted from the light emitting element through the sprocket holes Q1.

As shown in FIG. 3, a second sensor 82 for detecting the amount of conveyance roller 55 rotation (the media conveyance distance by the second conveyance mechanism) is also disposed to one end of the conveyance roller 55.

The second sensor 82 in this embodiment is a rotary encoder including a disc 82*a* attached to the roller shaft 57 of the conveyance roller 55, and a photosensor 82*b*. A pattern of opaque markers is formed at a specific pitch around the edge of the disc 82*a*. The photosensor 82*b* includes light emitting and detecting elements disposed on opposite sides of the disc 82*a*, and detects the rotation of the conveyance roller 55, or more specifically the conveyance distance of the paper R, by detecting the light that is emitted from the light emitting element and received by the light detecting element being blocked by the opaque pattern on the disc 82*a*.

The second sensor 82 can also be rendered with a rotary encoder that uses a reflective photosensor similar to the first sensor 81. The first sensor 81 can also be rendered as a rotary encoder using a transmissive photosensor similar to the second sensor 82.

The position where the ink droplets ejected by the printhead 26 land on the paper R must be precisely controlled in order to achieve high print quality, and the conveyance distance of the paper R by the conveyance roller 55 must therefore be precisely controlled. The detection precision of the second sensor 82 is therefore set higher than the detection precision of the first sensor 81 in this embodiment of the invention.

The detection results from the first sensor 81 and second sensor 82 are sent to a control unit 80. The control unit 80 determines how much to drive the conveyance motor 72 and outputs control signals based on the output from the first sensor 81 and second sensor 82 in order to execute specific paper conveyance operations and printing operations. The conveyance motor 72 drives the motor gear 71 the rotational amount indicated by the control signal.

A clutch mechanism 83 is also disposed between the conveyance motor 72 and the tractor 44 in the conveyance device 40 according to this embodiment of the invention. The clutch mechanism 83 is a friction clutch having a drive-side transfer member 83*a* and a follower-side transfer member 83*b*.

When the drive-side transfer member 83*a* and follower-side transfer member 83*b* couple, drive power from the conveyance motor 72 is transferred to the tractor 44, and the tractor 44 and conveyance roller 55 are driven synchronously through the power transfer mechanism 70.

When the drive-side transfer member 83*a* and follower-side transfer member 83*b* disengage, drive power from the conveyance motor 72 is not transferred to the tractor 44, and is transferred only to the conveyance roller 55 through the toothed belt 74.

When the drive-side transfer member 83*a* and follower-side transfer member 83*b* are allowed to slip, some drive power from the conveyance motor 72 can be transferred to the tractor 44 by means of friction between the clutch members.

The clutch mechanism 83 is configured to engage and disengage the drive-side transfer member 83*a* and follower-side transfer member 83*b* are according to a control signal from the control unit 80.

The clutch mechanism 83 according to this embodiment of the invention also functions as a torque limiter. When torque exceeding a specific level is applied to the tractor 44, the drive-side transfer member 83*a* and follower-side transfer member 83*b* disengage regardless of the control signal from the control unit 80, and transfer of drive power from the conveyance motor 72 to the tractor 44 is interrupted. When the torque drops below this specific level, the drive-side transfer member 83*a* and follower-side transfer member 83*b* engage again.

This specific torque level is set appropriately based on the tension applied to the paper R between the tractor 44 and conveyance roller 55, and the strength of the paper R.

The print medium (paper R) used in the inkjet printer 100 according to this embodiment of the invention is described with reference to FIG. 4.

Figure 4A:
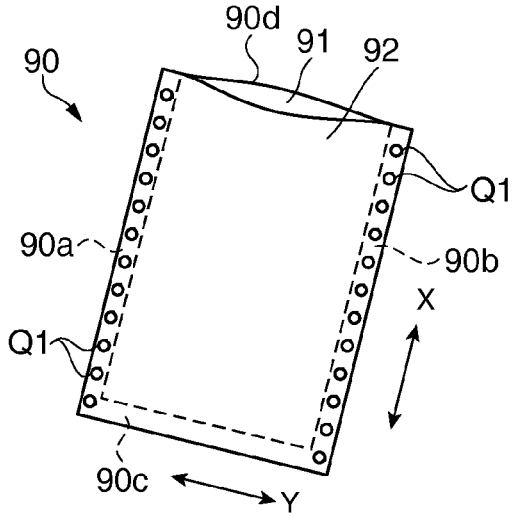
FIG. 4 shows examples of print media used in the inkjet printer shown in FIG. 1.

FIG. 4A shows an example of a single prescription envelope 90. A prescription envelope 90 is a paper bag that is used to hold prescription drugs received from a hospital or pharmacy, and has the patient name, drug name, and usage instructions printed on the outside.

The prescription envelope 90 used in this example has two layers including a transparent plastic sheet 91 and a paper sheet 92 that are glued together on three sides, both sides 90*a*, 90*b* on the y-axis and end 90*c* on the x-axis, and are not glued to leave an open end 90*d* on the x-axis, thus forming an envelope. The patient name and other information is printed on the paper sheet 92 portion of the prescription envelope 90 by an inkjet printer 100, and the drugs stored inside can be seen through the plastic sheet 91.

Figure 4B:
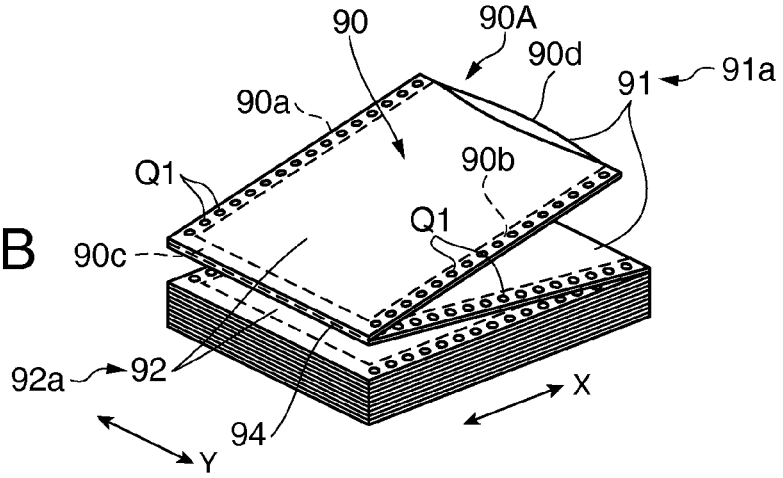

As shown in FIG. 4B, plural prescription envelopes 90 are connected together and supplied as a continuous prescription envelope web 90A. More specifically, the plastic sheet 91 and paper sheet 92 are provided as single continuous sheets 91*a*, 92*a* that are sealed with adhesive along edges 90*a*, 90*b* and have sprocket holes Q1 that can be engaged by the tractor pins 45 formed at a specific pitch along the x-axis in both edges 90*a*, 90*b*.

The continuous sheets 91*a*, 92*a* can be separated into individual sheets as shown in FIG. 4A by perforations 94 formed at specific intervals along the length (x-axis). One side of each perforation is sealed with adhesive across the width (y-axis). This sealed part corresponds to the bottom end 90*c* of each prescription envelope 90 described above.

The continuous prescription envelope web 90A is folded together at the perforations 94 into a fanfold stack. The continuous prescription envelope web 90A can thus be unfolded and conveyed from the stack by the conveyance device 40 with tractors 44, and supplied for continuous printing.

Figure 4C:
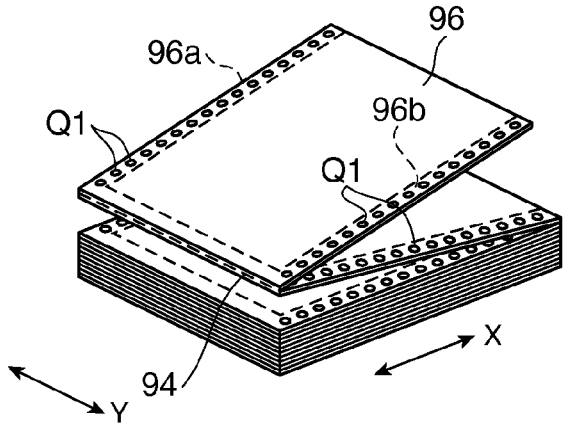

FIG. 4C shows standard fanfold paper 96 having sprocket holes Q1 formed at a specific pitch along the x-axis along the opposite edges 96*a*, 96*b* of the y-axis. The fanfold paper 96 can be separated into individual sheets at perforations 94 formed at specific intervals along the length (x-axis).

The operation of the inkjet printer 100 according to this embodiment of the invention, and particularly the paper R conveyance operation of the conveyance device 40, is described below.

The sprocket holes Q1 formed in the edges 90*a*, 90*b* of the paper R are first set on the tractor pins 45 disposed to the tractor belts 46 of the tractors 44.

When the clutch mechanism 83 is engaged, that is, when the drive-side transfer member 83*a* and follower-side transfer member 83*b* are coupled, the control unit 80 drives the conveyance motor 72. The tractors 44 and conveyance roller 55 are both driven rotationally, and the paper R is conveyed through the conveyance path 41 toward the conveyance roller 55. The paper R conveyed by the tractor 44 is then nipped between the rotating conveyance roller 55 and pressure roller 58, and further conveyed to a specific indexing position (the start position of the printing operation).

As described above, the conveyance speed of the conveyance roller 55 is greater than the conveyance speed of the tractor 44. The paper holding force of the conveyance roller 55 is increased by the friction layer 59, but is still less than the paper holding force of the tractors 44 that engage the sprocket holes Q1 with tractor pins 45. The paper R is therefore conveyed with specific tension applied thereto on the conveyance roller 55 side. As a result, even fanfold paper 96 that is unfolded from a stack and supplied as the paper R can be conveyed to the indexing position with skewing and slack desirably removed.

When the control unit 80 determines based on the rotation of the drive sprocket 47 of the tractor 44 detected by the first sensor 81 that a specific condition is met, that is, that the paper R reached the indexing position, the control unit 80 controls the clutch mechanism 83 to disengage the drive-side transfer member 83*a* and follower-side transfer member 83*b*.

As a result, transfer of drive power from the conveyance motor 72 to the tractor 44 is interrupted, and only the conveyance roller 55 is rotationally driven through the power transfer mechanism 70. The control unit 80 then drives the conveyance motor 72 based on the rotation of the conveyance roller 55 detected by the second sensor 82, and rotates the conveyance roller 55 and prints with the printhead 26 while conveying the paper R through the conveyance path 41.

Because the surface friction layer 59 containing a dispersion of inorganic particles has an extremely high coefficient of friction, the paper R is held by the conveyance roller 55 and pressure roller 58 with substantially no slipping. The tractors 44, to which transfer of drive power from the motor gear 71 is interrupted, rotate following the conveyance roller 55 with the tractor pins 45 engaged in the sprocket holes Q1 pulled in the conveyance direction (x-axis) by conveyance of the paper R by the conveyance roller 55.

Because the conveyance distance of the paper R can thus be controlled by rotationally driving only the conveyance roller 55, and the tractor 44 simply rotates following the conveyance roller 55, rotational operation of the tractor 44 can be prevented from affecting conveyance control by the conveyance roller 55. High quality printing is therefore possible because the paper R is conveyed with high precision and substantially no slipping by the conveyance roller 55 having friction layer 59, and the conveyance distance can be managed by the control unit 80 based on the output of a second sensor 82 having high detection precision.

While suppressing the parts cost by using a power transfer mechanism 70 that can rotationally drive both the tractors 44 of the first conveyance mechanism 43 and the conveyance roller 55 of the second conveyance mechanism 53 by means of a single conveyance motor 72, the possibility of cumulative conveyance error by the tractors 44 affecting the conveyance operation of the conveyance roller 55 can also be eliminated by using a clutch mechanism 83 that interrupts transfer of drive power from the motor gear 71 to the tractors 44 when conveying the paper R by the conveyance roller 55.

The paper R conveyed by the conveyance roller 55 is supplied past the printing position A of the print unit 25 for printing by the printhead 26, and is nipped between the rotating discharge roller 65 and pressure roller 68. The paper R further conveyed through the conveyance path 41 by the discharge roller 65 is then discharged from the paper exit 14.

The clutch mechanism 83 of the conveyance device 40 in this embodiment also functions as a torque limiter that interrupts transfer of drive power from the conveyance motor 72 to the tractors 44 as described above when torque exceeding a specific level is applied to the tractors 44.

For example, when a continuous prescription envelope web 90A such as shown in FIG. 4B is used as the paper R, unanticipated changes in the conveyance state can occur and excessive tension may be applied between the tractors 44 and the conveyance roller 55 because of the overlapping sheets of different materials and variations in thickness and stiffness where the sheets are glued together.

When this occurs, however, the drive-side transfer member 83*a* and follower-side transfer member 83*b* automatically disengage and damage to the paper R by excessive tension is prevented. The drive-side transfer member 83*a* and follower-side transfer member 83*b* then re-engage when the torque applied to the tractors 44 drops below the threshold, and conveyance can continue while applying appropriate tension to the paper R.

When the paper R must be conveyed in reverse to the upstream side of the conveyance direction (x-axis), the control unit 80 engages the clutch mechanism 83 so that drive power is transferred from the conveyance motor 72 to the tractors 44 and the tractors 44 can be driven in reverse during reverse conveyance. In this case the conveyance speed of the tractors 44 is set to a faster speed than the conveyance speed of the conveyance roller 55. The paper R is therefore pulled by the tractor pins 45 engaged in the sprocket holes Q1, and conveyed toward the supply opening 15.

Because there is substantially no slipping between the conveyance roller 55 and the paper R, extremely high tension is momentarily applied to the paper R between the tractors 44 and conveyance roller 55 when the conveyance motor 72 is reversed and reverse conveyance starts when the paper R is being conveyed in the normal forward direction (downstream in the conveyance direction).

However, the clutch mechanism 83 in the conveyance device 40 according to this embodiment functions as a torque limiter when this tension applies torque exceeding the threshold to the tractors 44, and interrupts transfer of drive power from the conveyance motor 72 to the tractors 44. As a result, high precision conveyance using the conveyance roller 55 with a strong paper holding force can be achieved while the paper R will also not be damaged by high tension produced when the tractors 44 reverse.

When the tension on the paper R between the conveyance roller 55 and tractors 44 goes to a suitable level, that is, when the torque on the tractors 44 drops below the threshold, the clutch mechanism 83 re-engages and the paper R can be conveyed in reverse by the tractors 44.

The foregoing embodiment is described to simplify understanding the invention, and the invention is not limited thereby. The invention can be changed and improved in many ways without departing from the scope of the accompanying claims, and all such comparable embodiments are obviously also included in the scope of the invention.

As described above, completely interrupting the transfer of drive power from the conveyance motor 72 to the tractors 44 is not necessary when conveying the paper R with the conveyance roller 55. Configurations that transfer some drive power from the conveyance motor 72 to the tractors 44 by allowing the drive-side transfer member 83*a* and follower-side transfer member 83*b* of the clutch mechanism 83 to slip are also conceivable. This configuration enables rotationally driving the tractors 44 to assist pulling by the conveyance roller 55, and can reduce the load on the conveyance roller 55.

Driving both the first conveyance mechanism 43 and the second conveyance mechanism 53 with the conveyance motor 72 as a single drive power source through the power transfer mechanism 70 as described in the above embodiment is also not necessary. Configurations that rotationally drive the conveyance mechanisms with separate, independent drive power sources are also conceivable. When conveying the paper R with the second conveyance mechanism 53 in this case, the control unit 80 can simply stop the drive power source that drives the first conveyance mechanism 43 to interrupt transfer of drive power from that drive power source to the tractors 44.

The print medium having sprocket holes also does not need to be fanfold media. Configurations that supply paper from a paper roll are also conceivable, for example.

What is claimed is:

1. A print medium conveyance device comprising:

a first conveyance mechanism that sequentially engages engagement holes formed aligned in a print medium and conveys the print medium in a specific conveyance direction;

a second conveyance mechanism that is disposed on a downstream side of the first conveyance mechanism in the conveyance direction, and has a friction layer containing an inorganic particle dispersion formed on the surface;

a drive power source that drives the first conveyance mechanism and second conveyance mechanism;

a clutch mechanism that is disposed between the drive power source and the first conveyance mechanism, and interrupts transfer of drive power at least in part from the drive power source to the first conveyance mechanism under a specific condition; and a control unit that causes the first conveyance mechanism to follow the second conveyance mechanism by interrupting transfer of drive power from the drive power source to the first conveyance mechanism under a specific condition, wherein:

the first conveyance mechanism conveys the print medium at a faster speed than the conveyance speed of the second conveyance mechanism when conveying the print medium in reverse to an upstream side of the conveyance direction.

2. The print medium conveyance device described in claim 1, wherein: the clutch mechanism interrupts transfer of drive power when torque exceeding a specific threshold is applied to the first conveyance mechanism.

3. The print medium conveyance device described in claim 2, wherein: the specific threshold is set based on tension applied to the print medium located between the second conveyance mechanism and the first conveyance mechanism, and the strength of the print medium.

4. The print medium conveyance device described in claim 1, further comprising: a transfer mechanism that transfers drive power from the drive power source to both the first conveyance mechanism and second conveyance mechanism.

5. The print medium conveyance device described in claim 1, wherein: the inorganic particles comprise aluminum oxide particles.

6. The print medium conveyance device described in claim 1, wherein: the print medium conveyance speed of the second conveyance mechanism is set greater than the print medium conveyance speed of the first conveyance mechanism.

7. The print medium conveyance device described in claim 1, further comprising:

a first sensor that detects the print medium conveyance distance by the first conveyance mechanism; and a second sensor that detects the print medium conveyance distance by the second conveyance mechanism, and has detection precision that is greater than the detection precision of the first sensor.

8. The print medium conveyance device described in claim 1, wherein:

the first conveyance mechanism is a tractor; and the second conveyance mechanism is a conveyance roller.

9. A printing device comprising:

a tractor that engages sprocket holes in a print medium and conveys the print medium along a conveyance path;

a conveyance roller that is disposed at the conveyance path on a downstream side of the tractor, and conveys the print medium along the conveyance path;

an inkjet head that is disposed to the conveyance path on the downstream side of the conveyance roller and prints on the print medium;

a drive power source that drives the tractor;

a clutch that is disposed between the tractor and the drive power source; and a control unit that causes the tractor to follow the conveyance roller by interrupting transfer of drive power from the drive power source to the tractor under a specific condition, wherein:

the tractor conveys the print medium at a faster speed than the conveyance speed of the conveyance roller when conveying the print medium in reverse to an upstream side of the conveyance path.

10. The printing device described in claim 9, wherein: the print medium is fanfold paper.

11. The printing device described in claim 9, wherein: the clutch interrupts transfer of drive power from the drive power source to the tractor when torque exceeding a specific threshold is applied to the tractor.

12. The printing device described in claim 11, wherein: the specific threshold is set based on tension applied to the print medium located between the conveyance roller and the tractor, and the strength of the print medium.

13. The printing device described in claim 9, further comprising: a transfer mechanism that transfers drive power from the drive power source to both the tractor and the conveyance roller.

* * * * *